US006126208A

United States Patent [19]

Asada et al.

[11] Patent Number: 6,126,208

[45] **Date of Patent: *Oct. 3, 2000**

[54] COMMON RAIL AND METHOD OF MANUFACTURING THE SAME

[75] Inventors: Kikuo Asada, Mishima; Masayoshi Usui, Numazu; Eiji Watanabe, Shizuoka Prefecture; Kazunori Takikawa; Ryuichi Kusanagi, both of Numazu, all of Japan

[73] Assignee: Usui Kokusai Sangyo Kaisha Limited, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/033,344

[22] Filed: Mar. 2, 1998

[30] Foreign Application Priority Data

Mar. 3, 1997 [JP] Japan ..... 9-063844

[51] Int. Cl.[7] ..... A16L 41/08

[52] U.S. Cl. ..... 285/133.4; 285/197; 285/288.1; 285/382; 29/890.148; 123/468

[58] Field of Search ..... 123/456, 468; 285/133.4, 197, 288.1, 382; 29/890.148

[56] References Cited

U.S. PATENT DOCUMENTS

| | | | |
|---|---|---|---|
| 315,074 | 4/1885 | Root . | |
| 1,264,854 | 4/1918 | Possons . | |
| 1,336,423 | 4/1920 | Chadwick . | |
| 1,476,756 | 12/1923 | Junkers . | |
| 1,519,010 | 12/1924 | Reznor . | |
| 1,545,493 | 7/1925 | Hoffman . | |
| 1,841,879 | 1/1932 | Croxford . | |
| 2,041,209 | 5/1936 | Ridley . | |
| 2,426,106 | 8/1947 | Kinley . | |
| 2,859,870 | 11/1958 | Hitz . | |
| 3,068,029 | 12/1962 | Schwartz . | |
| 3,082,850 | 3/1963 | Weening . | |
| 3,094,137 | 6/1963 | Burke . | |
| 3,259,003 | 7/1966 | Griffin . | |
| 3,277,683 | 10/1966 | Knoblock . | |
| 4,129,028 | 12/1978 | Leftheris et al. | 72/430 |
| 4,364,406 | 12/1982 | Bohlin . | |
| 4,399,829 | 8/1983 | Schuler . | |
| 4,680,845 | 7/1987 | Miller . | |
| 4,741,081 | 5/1988 | Redman . | |
| 4,832,376 | 5/1989 | Sugao . | |
| 4,893,601 | 1/1990 | Sugao . | |
| 4,900,180 | 2/1990 | Takikawa . | |
| 4,953,896 | 9/1990 | Usui . | |
| 4,979,295 | 12/1990 | Stagni et al. . | |

(List continued on next page.)

FOREIGN PATENT DOCUMENTS

| | | | |
|---|---|---|---|
| 806413 | 12/1936 | France | 29/890.15 |
| 506067 | 1/1957 | Italy . | |
| 2-80289 | of 1990 | Japan . | |
| 3-177693 | of 1991 | Japan . | |
| 4-175462 | of 1992 | Japan . | |
| 88663 | 7/1958 | Netherlands | 29/890.15 |
| 659623 | 10/1951 | United Kingdom . | |
| 836524 | 6/1960 | United Kingdom | 29/890.15 |

*Primary Examiner*—Dave W. Arola
*Attorney, Agent, or Firm*—Anthony J. Casella; Gerald E. Hespos; Michael J. Porco

[57] ABSTRACT

A common rail includes a generally cylindrical peripheral wall having a communication passage extending axially therethrough. At least one branch hole extends through the peripheral wall and is aligned perpendicular to the axis of the common rail. The intersection of the branch hole with the outer surface of the main pipe rail defines an outwardly flared pressure receiving seat for receiving the connection head portion of a branch pipe. A sleeve nipple is welded or brazed to the outer surface of the main pipe rail and surrounds the branch hole. Inner surface regions of the peripheral wall surrounding the branch hole have a compression residual stress imparted thereto. The creation of the compression residual stress may cause a portion of the inner surface of the main pipe rail surrounding the branch hole to assume a non-cylindrical configuration.

7 Claims, 11 Drawing Sheets

U.S. PATENT DOCUMENTS 5,072,710 12/1991 Washizu ..... 123/470
5,120,084 6/1992 Hashimoto .
5,136,999 8/1992 Bassler et al. ..... 123/470
5,143,410 9/1992 Takikawa .
5,169,182 12/1992 Hashimoto .
5,172,939 12/1992 Hashimoto .
5,192,026 3/1993 Rix et al. ..... 239/533.3
5,265,456 11/1993 Kennedy et al. ..... 72/342.7
5,667,225 9/1997 Kato .
5,887,910 3/1999 Usui .
5,957,507 9/1999 Asada .

Fig. 9 (A)
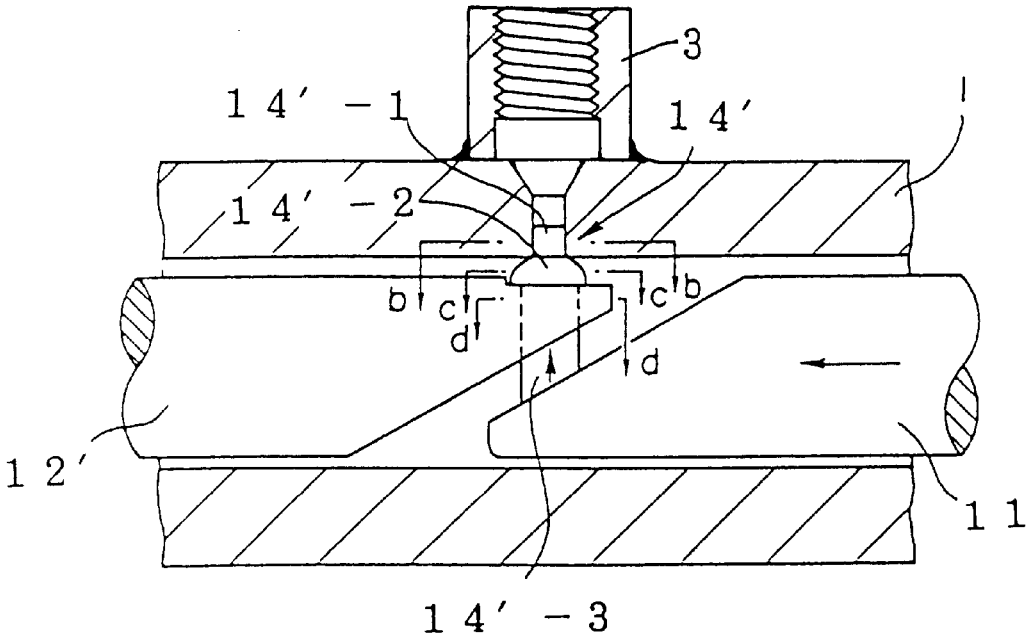
Fig. 9 (B)
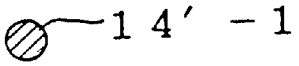
Fig. 9 (C)
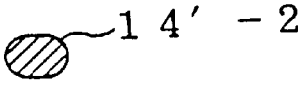
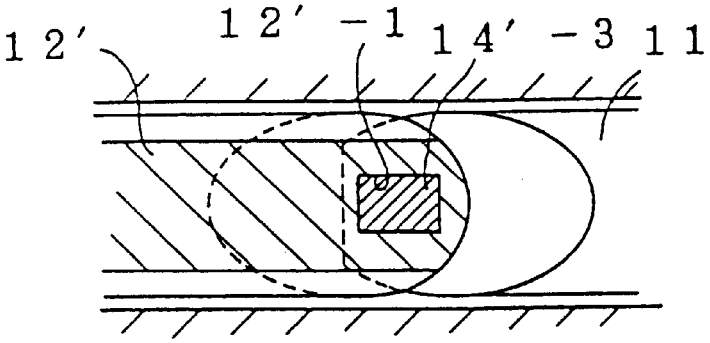
Fig. 9 (D)

COMMON RAIL AND METHOD OF MANUFACTURING THE SAME

BACKGROUND OF THE INVENTION

1. Field of the invention

The present invention generally relates to a common rail such as a high pressure fuel manifold in an accumulator fuel injection system of a diesel engine or a block rail.

2. Description of the prior arts

Conventionally, as thick kind of common rail, for example, as shown in FIG. 12, there has been known a common rail of the type which is structured such that a branch hole 21-2 portion communicating with an inner communication passage 21-1 disposed in a peripheral wall portion of a main pipe rail 21 end constituted by a circular pipe is made a pressure receiving seat surface 21-3 open to an outer direction, a cylindrical sleeve nipple 23 is mounted to an outer peripheral wall of the main pipe rail 21 near the pressure receiving seat surface by welding or brazing, and a pressing seat surface 22-3 constituted by a connection head portion 22-2 of a branch pipe 22 is brought into contact and engaged with the pressure receiving seat surface 21-3 close to the main pipe rail 21, thereby fastening and connecting together with pressing under the connection head portion 22-2 neck by means of an engagement between the sleeve nipple 23 and a fastening inside screw nut 24 previously assembled in the branch pipe end. In the drawing, reference numeral 22-1 denotes a flow passage of the branch pipe 22. In this case, the common rail shown in FIG. 12 employs an inside screw type for the screwing means, however, there is a common rail employing an outside screw type.

However, in the case of the common rail of the type that the cylindrical sleeve nipple type common rail which is structured such that the cylindrical sleeve nipple 23 is directly mounted to the main pipe rail 21 by welding or brazing and the nut 24 meshed with the sleeve nipple 23 is fastened and connected, as shown in FIG. 12, a great tensile stress is generated in an inner peripheral edge portion P of a lower end of the branch hole 12-2 due to an axial force applied to the pressure receiving seat surface 21-3 together with the internal pressure of the main pipe rail 21 and the pressing of the connection head portion 22-2 in the branch pipe 22, so that a crack is easily generated with starting from the lower end inner peripheral edge portion P and there is a possibility of inviting a leakage.

SUMMARY OF THE INVENTION

The present invention is made so as to solve the conventional problems mentioned above, and an object of the invention is to provide a common rail which can reduce a maximum tensile stress value generated in an inner peripheral edge portion of a lower end of a branch hole and can improve an internal pressure fatigue strength and a method of manufacturing the same.

In order to achieve the object mentioned above, in accordance with a first aspect of the invention, there is provided a common rail comprising at least one branch hole provided in an axial peripheral wall portion of a main pipe rail having a communication passage in an inner portion in a direction of an axial core thereof, a pressure receiving seat surface communicating with a branch pipe having a communication passage communicating with said communication passage in a peripheral surface portion of said branch hole and open to an outer portion, thereby bringing a pressing seat surface portion constituted by a connection head portion disposed in an end portion of said branch pipe into contact and engaging therewith, and a sleeve nipple attached to the main pipe rail by welding or brazing and a nut previously assembled in the branch pipe end which are meshed with each other so as to be pressed under a neck portion of said connection head portion, thereby being fastened and connected, in which a compression residual stress is present at a portion near the open end portion of the communication passage of the main pipe rail in said branch hole.

Further, in accordance with a second aspect of the invention, there is provided a method of manufacturing a common rail comprising at least one branch hole provided in an axial peripheral wall portion of a main pipe rail having a communication passage in an inner portion in a direction of an axial core thereof, a pressure receiving seat surface communicating with a branch pipe having a communication passage communicating with said communication passage in a peripheral surface portion of said branch hole and open to an outer portion, thereby bringing a pressing seat surface portion constituted by a connection head portion disposed in an end portion of said branch pipe into contact and engaging therewith, and a sleeve nipple attached to the main pipe rail by welding or brazing and a nut previously assembled in the branch pipe end which are meshed with each other so as to be pressed under a neck portion of said connection head portion, thereby being fastened and connected, in which it is preferable that a pressing force is applied to the main pipe rail near said branch hole from an outer portion to a diametrical direction, preferably by a press method, thereby generating a compression residual stress at a portion near the open end portion of the communication passage of the main pipe rail in said branch hole. Further, in this case, the branch hole is punched at the same time as the pressing force is applied to the main pipe rail near the branch hole form the outer portion to the diametrical direction by an external pressing method.

Still further, in accordance with a third aspect of the invention, there is provided a method of manufacturing a common rail comprising at least one branch hole provided in an axial peripheral wall portion of a main pipe rail having a communication passage in an inner portion of a direction of an axial core thereof, a pressure receiving seat surface communicating with a branch pipe having a communication passage communicating with said communication passage in a peripheral surface portion of said branch hole and open to an outer portion, thereby bringing a pressing seat surface portion constituted by a connection head portion disposed in an end portion of said branch pipe into contact and engaging therewith, and a sleeve nipple attached to the main pipe rail by welding or brazing and a nut previously assembled in the branch pipe end which are meshed with each other so as to be pressed under a neck portion of said connection head portion, thereby being fastened and connected, in which a pressing force is applied to an inner peripheral surface of the main pipe rail near said branch hole by an internal pressing method, thereby generating a compression residual stress at a portion near the open end portion of the communication passage of the main pipe rail in said branch hole.

Furthermore, in accordance with a fourth aspect of the invention, there is provided a method of manufacturing a common rail comprising at least one branch hole provided in an axial peripheral wall portion of a main pipe rail having a communication passage in an inner portion of a direction of an axial core thereof, a pressure receiving seat surface communicating with a branch pipe having a communication passage communicating with said communication passage in a peripheral surface portion of said branch hole and open to an outer portion, thereby bringing a pressing seat surface portion constituted by a connection head portion disposed in an end portion of said branch pipe into contact and engaging therewith, and a sleeve nipple attached to the main pipe rail by welding or brazing and a nut previously assembled in the branch pipe end which are meshed with each other so as to be pressed under a neck portion of said connection head portion, thereby being fastened and connected, in which a pressing force is applied to an inner peripheral surface of the main pipe rail near said branch hole by a pipe expansion method which applies a pressure to a pipe diametrical direction from an inner portion of the main pipe rail, thereby generating a compression residual stress at a portion near the open end portion of the communication passage of the main pipe rail in said branch hole.

Further, in accordance with a fifth aspect of the invention, there is provided a method of manufacturing a common rail comprising at least one branch hole provided in an axial peripheral wall portion of a main pipe rail having a communication passage in an inner portion in a direction of an axial core thereof, a pressure receiving seat surface communicating with a branch pipe having a communication passage communicating with said communication passage in a peripheral surface portion of said branch hole and open to an outer portion, thereby bringing a pressing seat surface portion constituted by a connection head portion disposed in an end portion of said branch pipe into contact and engaging therewith, and a sleeve nipple attached to the main pipe rail by welding or brazing and a nut previously assembled in the branch pipe end which are meshed with each other so as to be pressed under a neck portion of said connection head portion, thereby being fastened and connected, in which a pressing force is applied to an inner peripheral surface of said branch hole by a pipe expansion method which applies a pressure to a pipe diametrical direction from an inner portion of said branch hole, thereby generating a compression residual stress at a portion near the open end portion of the communication passage of the main pipe rail in said branch hole.

Still further, in accordance with a sixth aspect of the invention, there is provided a method of manufacturing a common rail comprising at least one branch hole provided in an axial peripheral wall portion of a main pipe rail having a communication passage in an inner portion in a direction of an axial core thereof, a pressure receiving seat surface communicating with a branch pipe having a communication passage communicating with said communication passage in a peripheral surface portion of said branch hole and open to an outer portion, thereby bringing a pressing seat surface portion constituted by a connection head portion disposed in an end portion of said branch pipe into contact and engaging therewith, and a sleeve nipple attached to the main pipe rail by welding or brazing and a nut previously assembled in the branch pipe end which are meshed with each other so as to be pressed under a neck portion of said connection head portion, thereby being fastened and connected, in which a piece-like body formed in a spherical body or having a tapered front end is pressed to an open end portion of the communication passage of the main pipe rail of said branch hole, thereby generating a compression residual stress at a portion near the open end portion of the communication passage of the main pipe rail in said branch hole.

Accordingly, in accordance with the invention, by remaining a compression residual stress at a portion near the open end portion of the communication passage of the main pipe rail in the branch hole, a tensile stress generated in an inner peripheral edge portion P of the lower end of the branch hole by an axial force applied to the pressure receiving seat surface together with an internal pressure of the main pipe rail and a pressing by the connection head portion of the branch pipe is canceled by said compression residual stress, thereby reducing a maximum tensile stress value generated in the inner peripheral edge portion of the lower end of the branch hole. As a method of generating and remaining a compression residual stress at a portion near the open end portion of the communication passage of the main pipe rail in the branch hole, the following methods are used, (1) a method of applying a pressing force to the main pipe rail from an outer portion in a diametrical direction by a press method, (2) a method of applying a pressure within the communication passage of the main pipe rail, (3) a pipe expansion method of applying a pressure from the inner portion of the main pipe rail in a pipe expanding direction, (4) a diameter expansion method of applying a pressure from the inner portion of the branch hole in a diametrical direction of the branch hole, or (5) a method of pressing a piece-like body formed in a spherical body or having a tapered front end to the open end portion of the communication passage of the main pipe rail in the branch hole.

In this case, the sleeve nipple is normally attached by welding or brazing before generating a compression residual stress, however, for example, in the case of using a welding such as a plasma welding or a laser welding, the sleeve nipple can be attached to the main pipe rail after generating a compression residual stress. Further, in the case of applying a pressing force by a press molding, it can be performed before and after punching the branch hole, or at the same time, and it is preferable to perform an internal pressure method and a pipe expansion method for one-way communication passage and a diameter expansion method for the branch hole after punching the branch hole.

In accordance with the invention, as (1) the method of applying a pressing force from the outer portion of the main pipe rail by a press method, for example, a method of pressing by a punch or a rod in a state of mounting the rail body on a female mold having a circular arc groove and pressing and fixing by right and left movable molds can be used.

Further, as (2) the method of applying a pressure within the communication passage of the main pipe rail, it is preferable to use a hydraulic pressure such as an oil pressure or a water pressure.

Next, as (3) the pipe expansion method of applying a pressing force from the inner portion of the main pipe rail to the pipe diametrical direction, for example, a method of pressure welding by a drawing-out method of a pressing method by means of a diameter expansion device such as a spherical body or a shell-like plug having a diameter slightly larger than an inner diameter of the communication passage within the communication passage of the main pipe rail, or a diameter expansion method by a vanishing tool can be used.

Further, as (4) the diameter expansion method of applying a pressure from the inner portion of the branch hole to a diametrical direction of the branch hole, a method of pressure welding a spherical body or a plug having a diameter slightly larger than an inner diameter of the branch hole by a pressing method can be used.

Still further, as (5) the method of pressing a piece-like body formed in a spherical body or having a tapered front end to the open end portion of the communication passage of the main pipe rail in the branch hole, with using a piece-like body formed in a spherical body or having a front end formed in a tapered conical shape, an oval conical shape or an oblong conical shape, for example, a method of inserting a rigid ball and a rigid ball receiver or a piece-like body having a tapered front end and a piece-like body receiver into the main pipe rail, arranging said rigid ball receiver or the piece-like receiver in such a manner that the spherical surface of the rigid ball or the front conical surface of the piece-like body is brought into contact with the open end portion of the communication passage of the main pipe rail in the branch hole, inserting and pressing a punch having a wedge-like front end from the other end portion of the main pipe rail and pressing the spherical surface of the rigid ball or the front end conical surface of the piece-like body to the open end portion of the communication passage of the main pipe rail in the branch hole can be used.

As mentioned above, in accordance with the invention, by remaining a compression residual stress at the portion near the open end portion of the communication passage of the main pipe rail in the branch hole, the tensile stress generated in the inner peripheral edge portion of the lower end of the branch hole at a time of a high pressure fuel accumulation to the communication passage in a use time can be canceled by a compression residual stress so as to be effectively restricted, thereby improving an internal pressure fatigue strength in the branch pipe connecting portion.

BRIEF DESCRIPTION OF THE DRAWINGS

FIGS. 2A, 2B, 2C, 2D and 2E are views showing pressing force application means in the manufacturing method mentioned above, in which FIG. 2A is a vertical cross sectional view which shows a method of pressing by using a punch having a pressing surface formed in an inverted concave shape in a state of being partially broken, FIG. 2B is a vertical cross sectional view which shows a method of pressing by using a punch having an annular projection provided on an inner bottom portion of a boss portion and a flat pressing surface, FIG. 2C is a vertical cross sectional view which shows a method of pressing by using a punch having the inner bottom portion of the boss portion formed in a concave shape and a pressing surface formed in a spherical surface, FIG. 2D is a vertical cross sectional view which shows a method of pressing by using a punch having the inner bottom portion of the boss portion projected in an angular shape and a pressing surface formed in a flat shape, and FIG. 2E is a vertical cross sectional view which shows a method of pressing by using a punch having a hole with a bottom having the same diameter as that of the branch hole in a center portion of the inner bottom portion of the boss portion and a projection having a diameter capable of fitting to the hole with the bottom formed on the pressing surface;

FIGS. 8A and 8B are schematic views which show a fifth embodiment of a method of manufacturing a common rail in accordance with the invention, in which FIG. 8A is a vertical cross sectional view of a branch hole portion which shows a method of pressing the open end portion of the communication passage of the main pipe rail in the branch hole by using a spherical body and FIG. 8B is a vertical cross sectional view of the branch hole portion which shows a method of pressing the open end portion of the communication passage of the main pipe rail in the branch hole by using a piece-like body having a tapered front end;

FIGS. 9A, 9B, 9C and 9D are schematic views which show a sixth embodiment of a method of manufacturing a common rail in accordance with the invention, in which FIG. 9A is a vertical cross sectional view of the sixth embodiment, FIG. 9B is a cross sectional view on a line b—b in FIG. 9A, FIG. 9C is a cross sectional view on a line c—c in FIG. 9A and FIG. 9D is a cross sectional view on a line d—d in FIG. 9A;

DETAILED DESCRIPTION OF THE PREFERRED EMBODIMENTS

Figure 1:
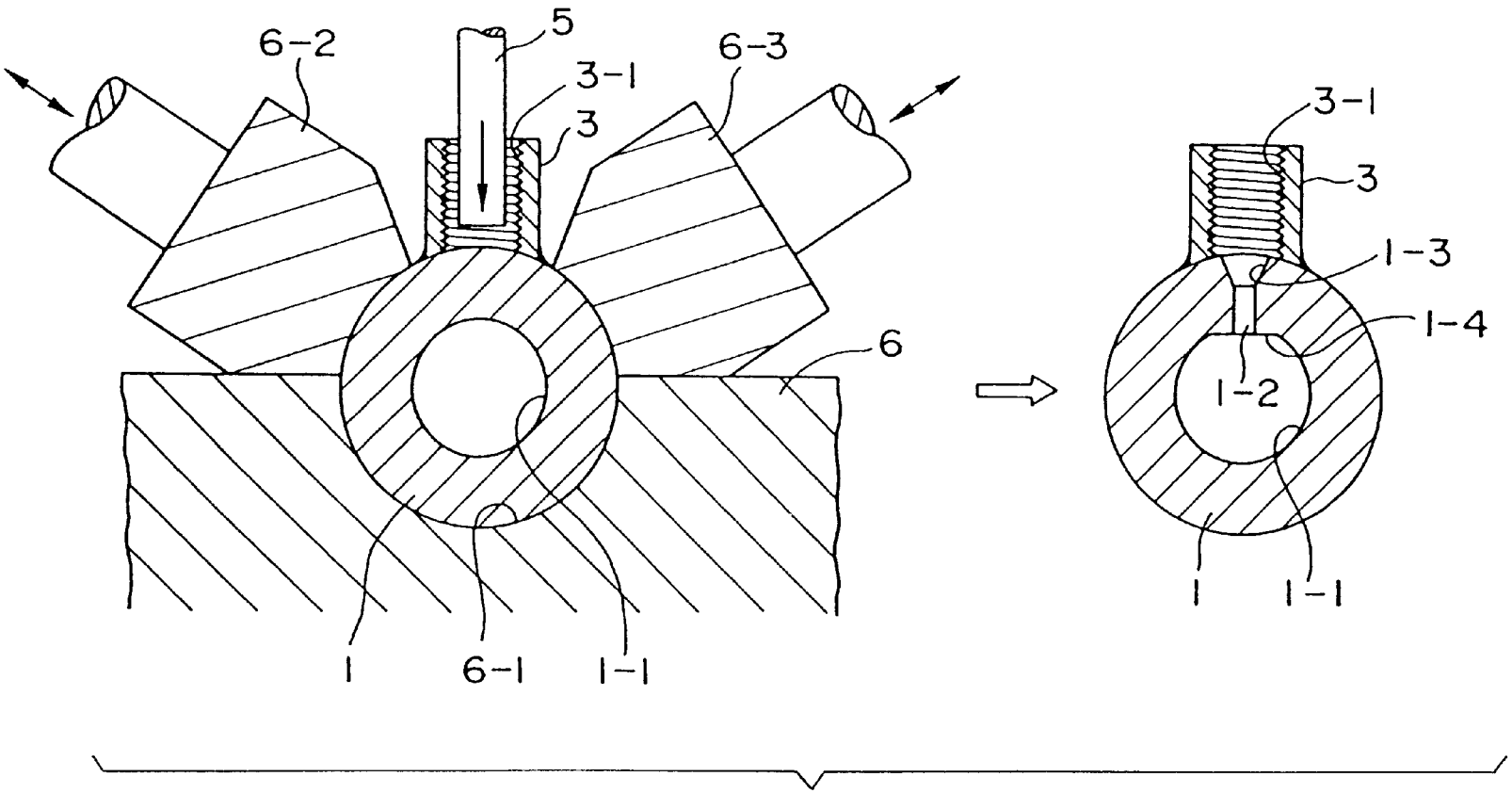
FIG. 1 is a schematic view which shows a first embodiment of a method of manufacturing a common rail in accordance with the invention.

In FIGS. 1 to 11, reference numeral 1 denotes a main pipe rail, reference numeral 2 denotes a branch pipe, reference numeral 3 denotes a sleeve nipple, reference numeral 4 denotes a fastening nut, reference numeral 5 denotes a punch, reference numeral 6 denotes a metal mold, reference numerals 7-1 and 7-2 denote a diameter expanding device, reference numeral 8 denotes a fixing jig, reference numeral 9 denotes a tension apparatus, reference numeral 10 denotes a pressing apparatus, reference numeral 11 denotes a punch, reference numeral 12 denotes a rigid ball receiver, and reference numeral 12' denotes a piece-like body receiver.

The main pipe rail 1 as a common rail is a high pressure piping steel pipe made of STS480 having relatively thick pipe-like portion, for example, having a diameter of 28 mm and a thickness of 9 mm, and an inner portion of an axial core thereof forms a communication passage 1-1.

In accordance with the invention, at first in the working process, the cylindrical sleeve nipple 3 having a screw surface 3-1 meshed with the fastening nut assembled to the branch pipe on the inner peripheral surface is directly mounted to an outer peripheral wall of the main pipe rail 1 as a joint metal fitting at a base end portion thereof by welding or brazing.

In a method shown in FIG. 1 in accordance with the invention, following to a pre-working process mentioned above, the portion near the mounting portion of the sleeve nipple 3 in the main pipe rail 1 is fixed by the metal mold 6 in a press process. The mold 6 is constituted by a metal mold having a concave cross section including a curved surface 7-1 having substantially the same radius of curvature as the outer peripheral surface of the main pipe rail 1, as shown in the drawing, and substantially lower half periphery of the main pipe rail 1 is fixed to the metal mold 6. Next, left and right movable metal molds 6-2 and 6-3 are activated by an actuator so as to hold an upper half periphery of the main pipe rail 1 except a portion near the portion in which the branch hole 1-2 is formed from both sides. This is necessary for sufficiently obtaining an effect by the press.

When the main pipe rail 1 is fixed to the metal mold 6, a pressing force is applied to an outer peripheral surface of the main pipe rail 1 toward an inner diameter in a diametrical direction on a central axis line of the sleeve nipple 3 by the punch 5 mounted to a press apparatus (not shown) and having a diameter smaller than an inner diameter of the sleeve nipple 3. As the pressing force at this time, although it is not specifically limited, it is sufficient to set a degree that the inner peripheral surface of the main pipe rail communication passage 1-1 positioned immediately below the punch 5 slightly projects so that a flat portion 1-4 is formed. Due to the pressing force by the punch 5, as well as the inner peripheral surface of the main pipe rail communication passage 1-1 slightly projects so as to form the flat portion 1-4, a plastically deformed portion and an elastically deformed portion are produced at a time of applying the pressing force, and a compression residual stress is generated due to a deformation generated by a difference of a return amount at a time of removing the pressing force.

Continuously, in a finish working process, the branch hole 1-2 is formed in the portion deformed in the pressing process of the main pipe rail 1, preferably on the center axis line pressed by the punch 5 in such a manner as to make the circular and outward open peripheral surface communicating with the communication passage 1-1 of the main pipe rail 1 and communicating with the communication passage a pressure receiving surface 1-3.

Figure 2A:
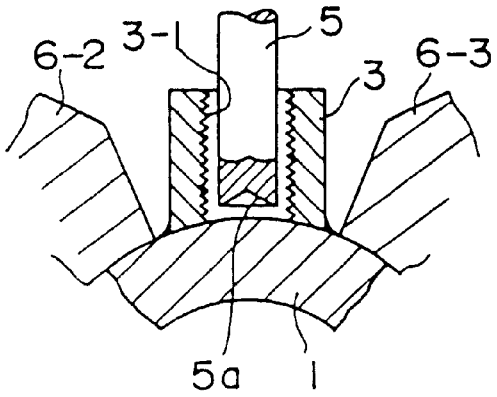

Next, FIG. 2 exemplifies pressing force application means by a press method for remaining a compression residual stress near the open end portion of the communication passage of the main pipe rail in the branch hole 1-2, in which FIG. 2A shows a method of forming a concave portion 5*a* having a triangular cross section in a front end portion (a pressing surface) of the punch 5 and applying a pressing force to the outer peripheral surface of the main pipe rail 1 by the punch 5. In the case of this method, since a great pressing force is applied to the peripheral portion in addition to the center portion of the outer peripheral surface of the main pipe rail surrounded by the sleeve nipple 3, a compression residual stress can be effectively remained in a relatively wide range near the branch hole 1-2 provided in the portion.

Figure 2B:
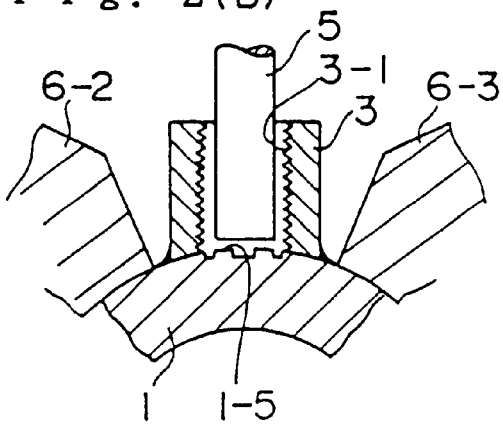

FIG. 2B shows a method of remaining a compression residual stress in a relatively wide range near the branch hole 1-2 which is later provided in the same manner as that of FIG. 2A by providing an annular projection 1-5 on the outer peripheral surface of the main pipe rail 1 surrounded by the sleeve nipple 3 and pressing an upper surface of the annular projection 1-5 by the punch 5 having a flat pressing surface.

Figure 2C:
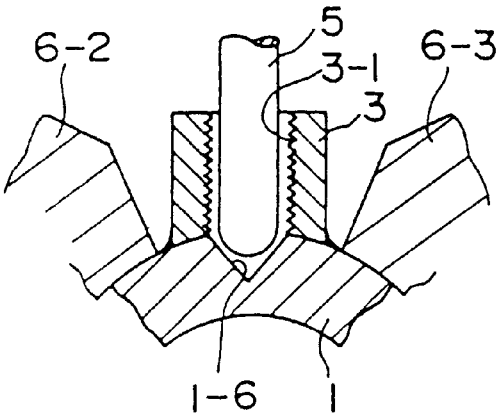

FIG. 2C shows a method of forming the outer peripheral surface of the main pipe rail 1 surrounded by the sleeve nipple 3 in a concave portion 1-6 having an inverted triangular cross sectional shape and pressing a bottom portion constituted by the concave portion 1-6 by the punch 5 having a spherical pressing surface. In this method, since an inclined surface of the bottom portion is first pressed, in this case, a compression residual stress is effectively remained near the branch hole 1-2 which is later provided.

Figure 2D:
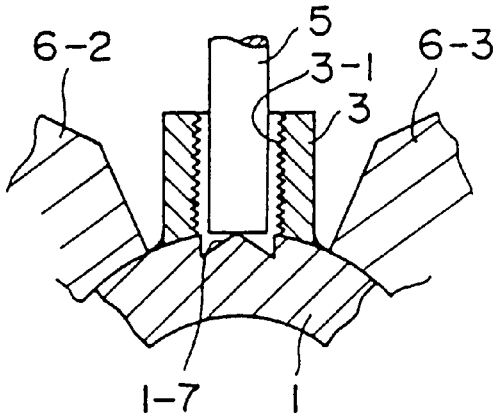

FIG. 2D shows a method of providing a projection 1-7 having an angular cross sectional shape on the outer peripheral surface of the main pipe rail 1 surrounded by the sleeve nipple 3 and pressing the bottom portion constituted by the projection 1-7 by the punch 5 having a flat pressing surface. In this method, since the projection 1-7 having an angular cross section is first pressed by the punch 5, a great pressing force is applied to the center portion of the bottom portion. Accordingly, also in this case, a great compression residual stress is remained near the branch hole 1-2 which is later provided in a concentrated manner.

Figure 2E:
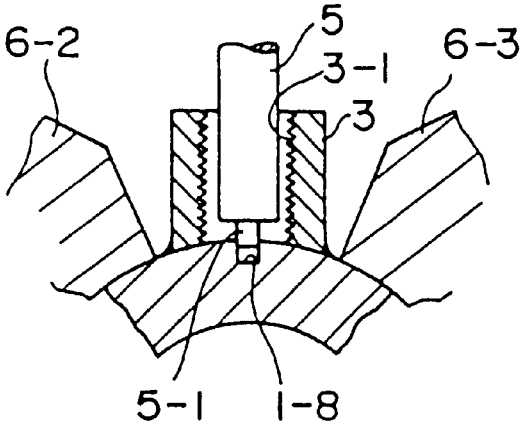

FIG. 2E shows a method of providing a hole with a bottom 1-8 having an appropriate depth and the same diameter as that of the branch hole 1-2 later provided in the center of the outer peripheral surface of the main pipe rail 1 surrounded by the sleeve nipple 3 and pressing the projection 5-1 having a diameter capable of fitting to the hole with a bottom 1-8 and a length slightly longer than a depth of the hole with a bottom by the punch 5 provided on the pressing surface. In the case of this method, since the peripheral portion of the hole with a bottom 1-8 is pressed at the same time as the hole with a bottom 1-8 is pressed by the projection 5-1, the pressing force is applied to the portion of the branch hole 1-2 later provided in a concentrated manner and a compression residual stress is necessarily remained near the branch hole 1-2. In this case, a shape of the punch and a shape formed on the outer peripheral surface of the main pipe rail in opposite to the front end of the punch are not limited to combinations of the shapes shown in FIGS. 2A to 2E.

As a method of applying a pressing force by a press method and generating a compression residual stress in accordance with the invention, not only the method mentioned above but also a method shown in FIG. 3 can be employed.

Figure 3:
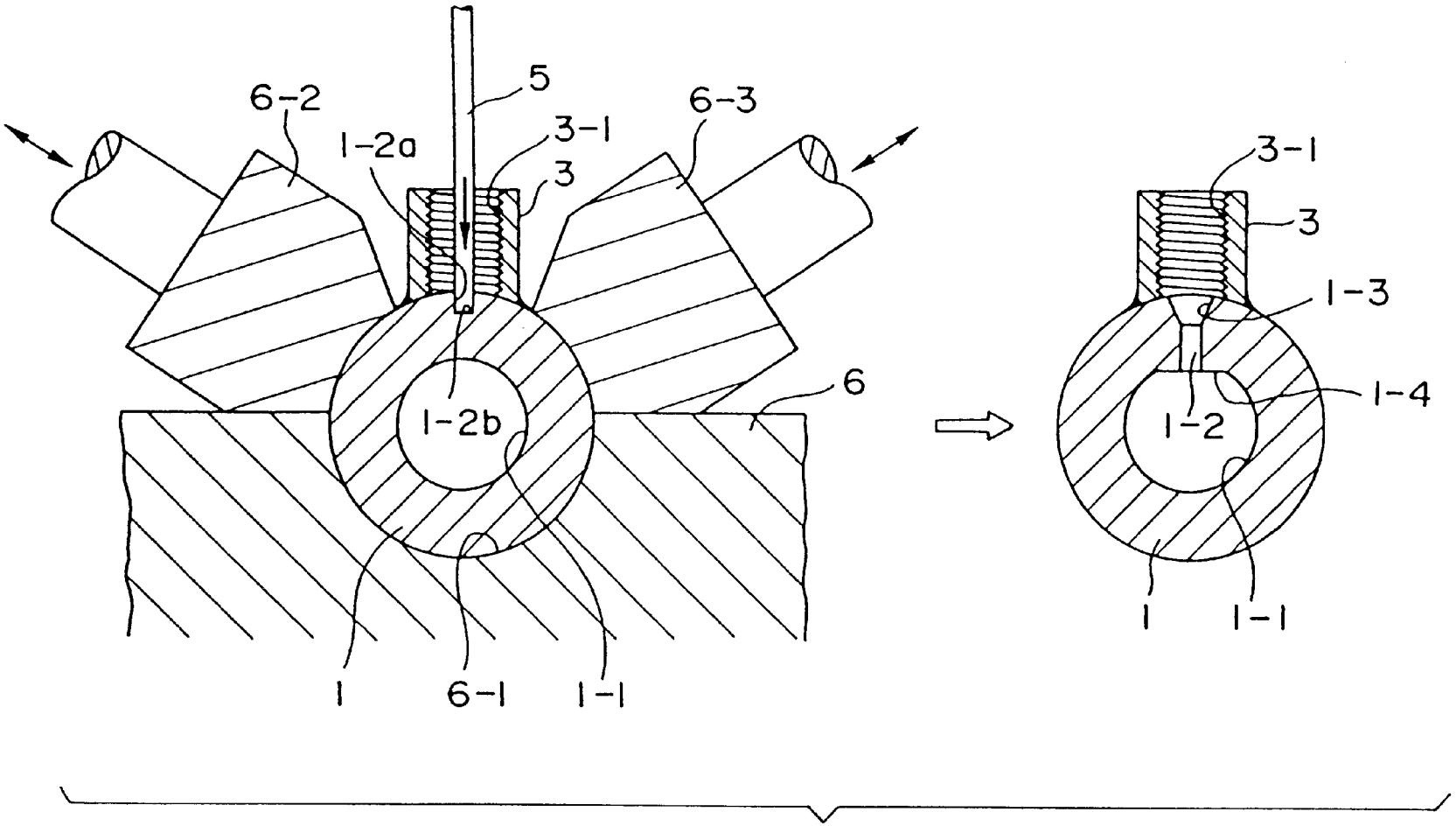
FIG. 3 is a schematic view which shows a modified embodiment of the manufacturing method shown in FIG. 1.

In FIG. 3, the structure is made such as to provide a hole with a bottom 1-2*a* having an appropriate depth and substantially the same diameter as that of the branch hole 1-2 having a predetermined hole diameter which is later provided and to press an inner bottom portion 1-2*b* of the hole with a bottom 1-2*a* to a diametrical direction by the punch 5 having a diameter capable of fitting to the hole with a bottom 1-2*a* and a length larger than a depth of the hole with a bottom. Since the inner bottom portion 1-2*b* is pressed by the punch 5, the pressing force is applied to the portion of the branch hole 1-2 later provided in a concentrated manner and a compression residual stress is necessarily remained also near the branch hole 1-2.

Thereafter, the hole with a bottom 1-2*a* is extended to the communication passage 1-1 by a cutting process by means of a drill, thereby forming the branch hole 1-2. Next, the pressure receiving seat surface 1-3 is formed in the circular and outward open peripheral surface.

Figure 4:
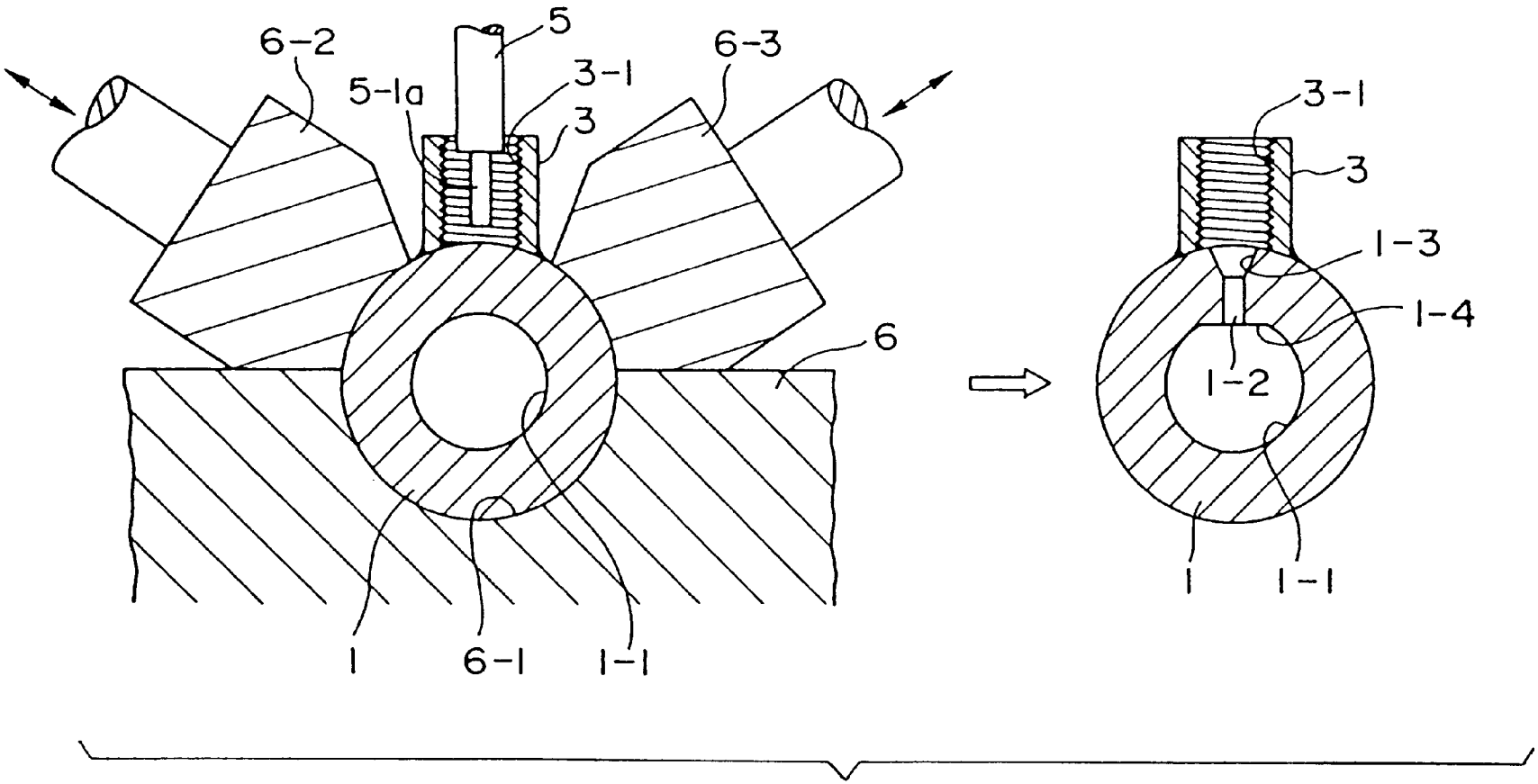
FIG. 4 is a schematic view which shows an embodiment of a method of punching a branch hole at the same time of applying a pressing force in the manufacturing method in accordance with the first embodiment of the invention.

Further, a method shown in FIG. 4 shows an embodiment of a method of punching the branch hole at the same time of applying a pressing force in the manufacturing method in accordance with the first embodiment, which corresponds to a method of punching the branch hole 1-2 with pressing the outer peripheral surface of the main pipe rail 1 by using the punch 5 provided with a projection 5-1*a* having a length longer than a thickness of the main pipe rail 1 and the same diameter as that of the branch hole 1-2 in the front end. In the case of this method, since the outer peripheral surface of the main pipe rail 1 is pressed by the projection 5-1*a*, the pressing force is applied to the portion of the branch hole 1-2 simultaneously punched in a concentrated manner, and a compression residual stress is necessarily generated near the branch hole 1-2.

Still further, as a method of applying a pressing force by a press method by means of a punch and generating a compression residual stress, the pressing force is not always applied to the center of the branch hole, but it is possible to apply the pressing force with slightly shifted from the portion in which the branch hole is formed and concentrate a compression residual stress to at least a part of the branch hole, that is, to an inner peripheral edge portion P in the axial direction of the main pipe rail in the lower end of the branch hole which becomes a starting point of a crack, thereby generating and remaining a compression residual stress.

Figure 5:
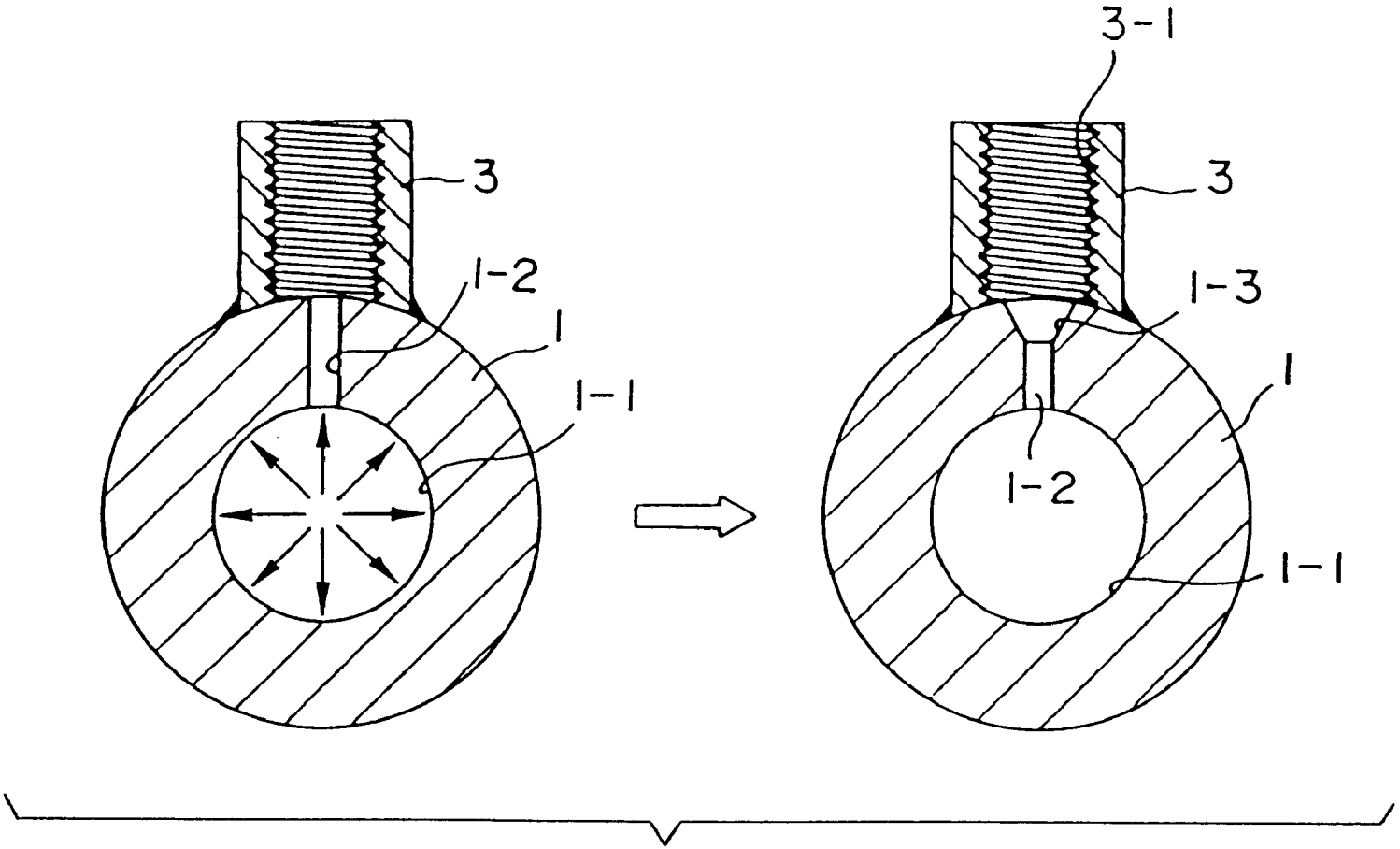
FIG. 5 is a schematic view which shows a second embodiment of a method of manufacturing a common rail in accordance with the invention.

A method shown in FIG. 5 corresponds to a case that an internal pressure method of applying a pressure within the communication passage 1-1 of the main pipe rail 1 is employed as means for generating a compression residual stress near the open end portion of the communication passage 1-1 of the main pipe rail in the branch hole 1-2. This method corresponds to a method of generating a compression residual stress near the open end portion of the communication passage of the main pipe rail in the branch hole 1-2 by a method of applying a high pressure by which at least 25%, preferably 50 to 75% of a thickness of the main pipe rail 1 is yielded from the inner peripheral surface side of the thickness of the main pipe rail 1 by feeding a liquid fluid such as a water or an oil within the rail in a state of sealing one side of the main pipe rail 1 mounting the sleeve nipple 3.

In this case, a working of the branch hole 1-2 is preferably performed before applying the internal pressure since a compression stress is securely remained, and further, the sleeve nipple 3 may be mounted at a finishing process after generating a compression residual stress near the open end portion of the communication passage of the main pipe rail.

Figure 6:
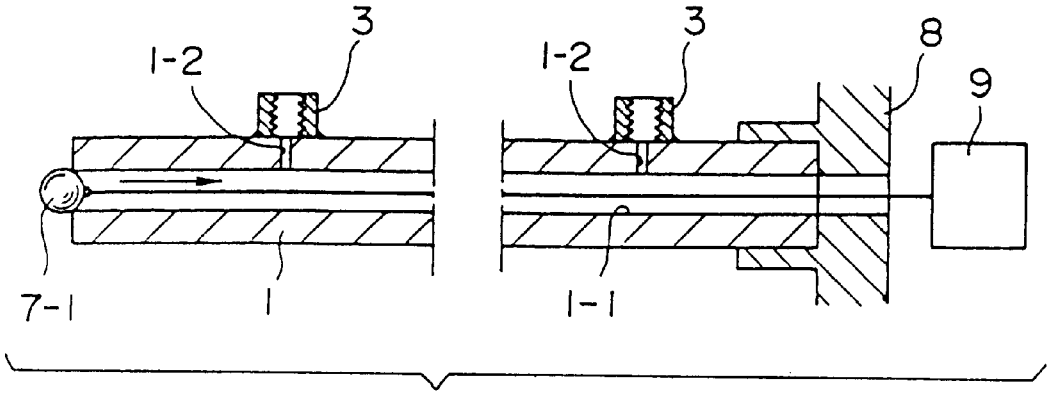
FIG. 6 is a schematic view which shows a third embodiment of a method of manufacturing a common rail in accordance with the invention.

Further, a method shown in FIG. 6 corresponds to a case that a pipe expansion method of applying a pressure to a pipe diametrical direction from the inner portion of the main pipe rail 1 is employed as means for generating a compression residual stress near the open end portion of the communication passage 1-1 of the main pipe rail in the branch hole 1-2. The method corresponds to a method of expanding the communication passage 1-1 of the main pipe rail by a method of drawing a diameter expansion device 7-1 having a diameter slightly larger than the inner diameter of the communication passage 1-1 such as a spherical body, a plug and a roller vanishing tool by a tension apparatus 9 so as to move within the communication passage 1-1 with being in press contact in a state of horizontally fixing the main pipe rail 1 to a fixing jig 8, and generating and remaining a compression residual stress near the open end portion of the communication passage of the main pipe rail in the branch hole 1-2.

In this case, when the branch hole 1-2 is punched before a diameter expanding operation against the inner peripheral surface of the main pipe rail 1, it is preferable since the compression stress is securely remained near the open end portion of the branch hole 1-2.

Figure 7:
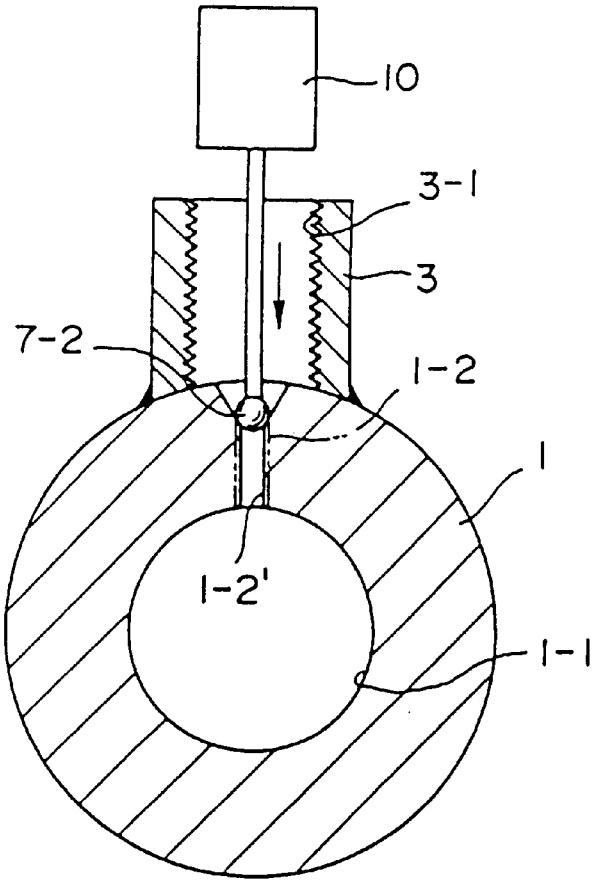
FIG. 7 is a schematic view which shows a fourth embodiment of a method of manufacturing a common rail in accordance with the invention.

Still further, a method shown in FIG. 7 corresponds to a method of punching a branch hole 1-2' having a diamter slightly smaller than a predetermined hole diameter on the main pipe rail in a finish work process, expanding the branch hole 1-2' by a method of pressing a diameter expansion device 7-2 having substantially the same diameter as the inner diameter of the branch hole 1-2 having a predetermined hole diameter such as a spherical body or a plug into the branch hole 1-2' having the small diamter by means of a pressing method, and generating a compression residual stress near the open end portion of the communication passage of the main pipe rail in the branch hole 1-2, as means for generating a compression residual stress near the open end portion of the communication passage 1-1 of the main pipe rail in the branch hole 1-2.

A method shown in FIG. 8A exemplifies a method of generating a compression residual stress in the open end portion of the communication passage of the main pipe rail in the branch hole 1-2 by using a rigid ball 13. In this method, a rigid ball 13 and a rod-like rigid ball receiver 12 are inserted into the main pipe rail 1, the rigid ball receiver 12 is disposed in such a manner that a spherical surface of the rigid ball 13 is brought into contact with the open end portion of the communication passage of the main pipe rail in the branch hole 1-2, and a punch 11 having a front end portion formed in a wedge shape is inserted from the other end portion of the main pipe rail, thereby mounting the rigid ball 13 on the inclined slide surface in the front end portion. In this state, when the punch 11 is pressed, a force in a direction of the branch hole is applied to the rigid ball 13 due to a wedge effect by the punch 11, so that the rigid ball 13 is pressed to the open end portion of the communication passage of the main pipe rail in the branch hole 1-2.

Then, a load is applied by pressing the punch 11 until reaching to a necessary pressure, thereby strongly pressing the rigid ball 13 to the open end portion of the communication passage of the main pipe rail, and thereafter, the rigid ball 13, the rigid ball receiver 12 and the punch 11 are removed from the main pipe rail 1. In the case of this method, since a pressing force is applied to the open end portion of the communication passage of the main pipe rail in the branch hole 1-2 by the rigid ball 13 pressed by the punch 11, a compression residual stress can be effectively generated and remained near the open end portion of the communication passage of the main pipe rail in the branch hole 1-2.

Further, a method shown in FIG. 8B exemplifies a method of generating a compression residual stress in the open end portion of the communication passage of the main pipe rail in the branch hole 1-2 by using a piece-like body 14 having a front end formed in a conical shape in place of the rigid ball 13. In this method, in accordance with the same operation order as that mentioned above, a piece-like body 14 and a piece-like body receiver 12' are inserted into the main pipe rail 1, the piece-like body receiver 12' is disposed in such a manner that a conical surface of the piece-like body 14 is brought into contact with the open end portion of the communication passage of the main pipe rail in the branch hole 1-2, and the punch 11 having a front end portion formed in a wedge shape is inserted from the other end portion of the main pipe rail, thereby mounting the piece-like body 14 on the inclined slide surface of the front end portion. In this state, when the punch 11 is pressed, a force in a direction of the branch hole is applied to the piece-like body 14 due to a wedge effect by the front end portion of the punch 11 in the same manner as that of the rigid ball case mentioned above, so that the piece-like body 14 is pressed to the open end portion of the communication passage of the main pipe rail in the branch hole 1-2. Then, a load is applied by pressing the punch 11 until reaching to a necessary pressure, thereby strongly pressing the piece-like body 14 to the open end portion of the communication passage of the main pipe rail, and thereafter, the piece-like body, the piece-like body receiver 12' and the punch 11 are removed from the main pipe rail 1. Accordingly, in accordance with this method, since a pressing force is applied to the open end portion of the communication passage of the main pipe rail in the branch hole 1-2 by the piece-like body 14 pressed by the punch 11, a compression residual stress can be effectively generated and remained near the open end portion of the communication passage of the main pipe rail in the branch hole 1-2, in the same manner as that of the rigid ball.

It is preferable to use a piece-like body 14' having a structure shown in FIG. 9 in place of the piece-like body 14 shown in FIG. 8B. The piece-like body 14' shown in FIG. 9 is constituted by an integral combination of a front end portion 14'-1 having a circular cross section, a pressing portion 14'-2 having an oblong cross section and a base portion 14'-3 having a rectangular cross section. The front end portion 14'-1 having a circular cross section has a circular cross sectional shape substantially aligned with an inner diameter of the branch hole 1-2 for being guided to the branch hole 1-2 so as to accurately position the piece-like body 14'. Further, the pressing portion 14'-2 having an oblong cross section has an oblong cross sectional shape making a longitudinal direction of the communication passage 1-1 a long line for concentrically pressing both sides of the main pipe rail 1 of the lower end inner peripheral edge portion in the branch hole 1-2 in which a great tensile stress is easily generated among the open end portion of the communication passage of the main pipe rail. Still further, the base portion 14'-3 having a rectangular cross section has a rectangular cross sectional shape for securing a directivity of the piece-like body 14' by fitting to a rectangular hole 12'-1 provided in the front end portion of the piece-like body receiver 12'.

Figure 8:
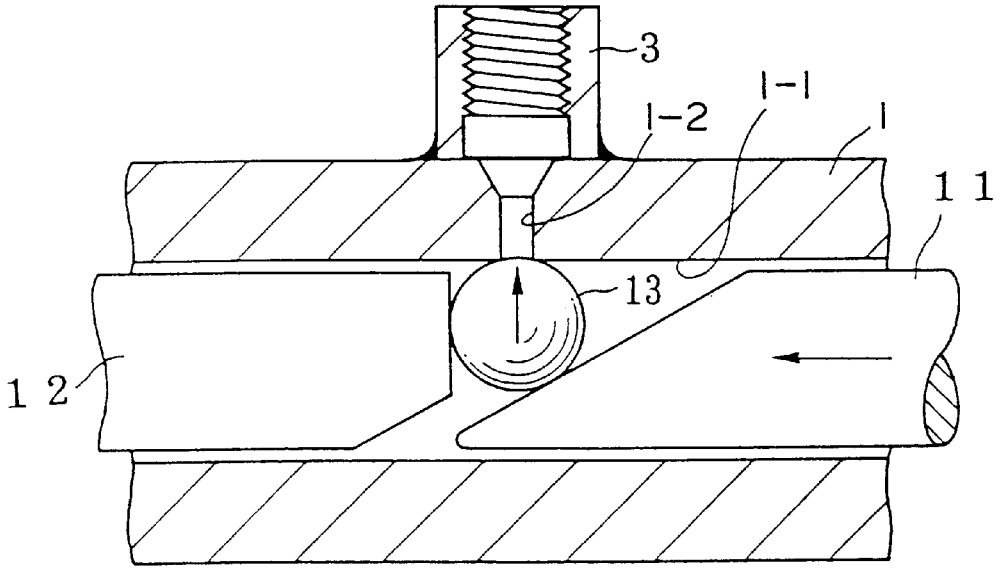
Figure 8:
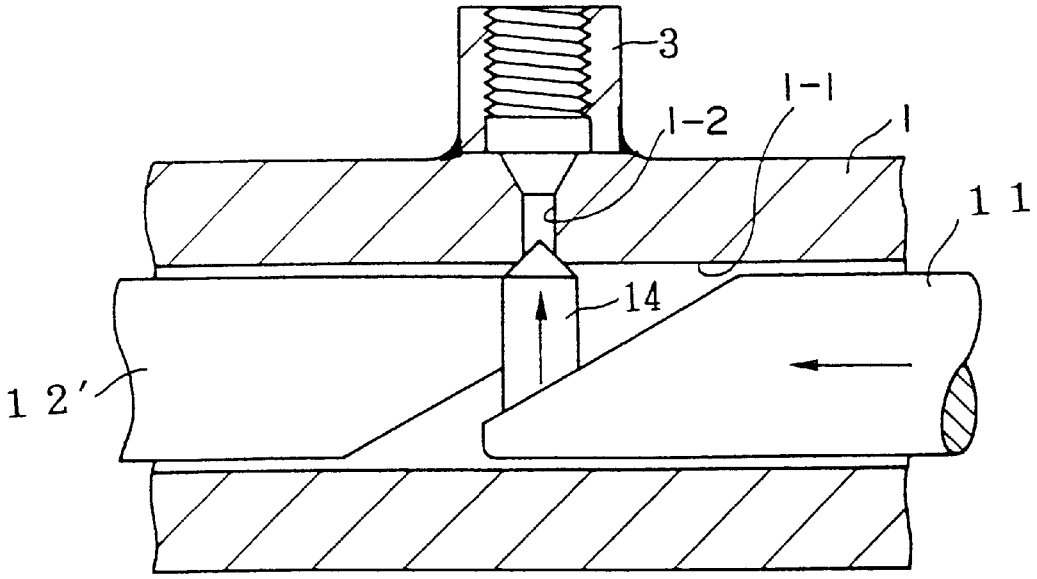

An operation order for effectively generating and remaining a compression residual stress near the open end portion of the communication passage of the main pipe rail in accordance with the method shown in FIG. 9 is the same as the manner as that shown in FIG. 8.

Figure 10:
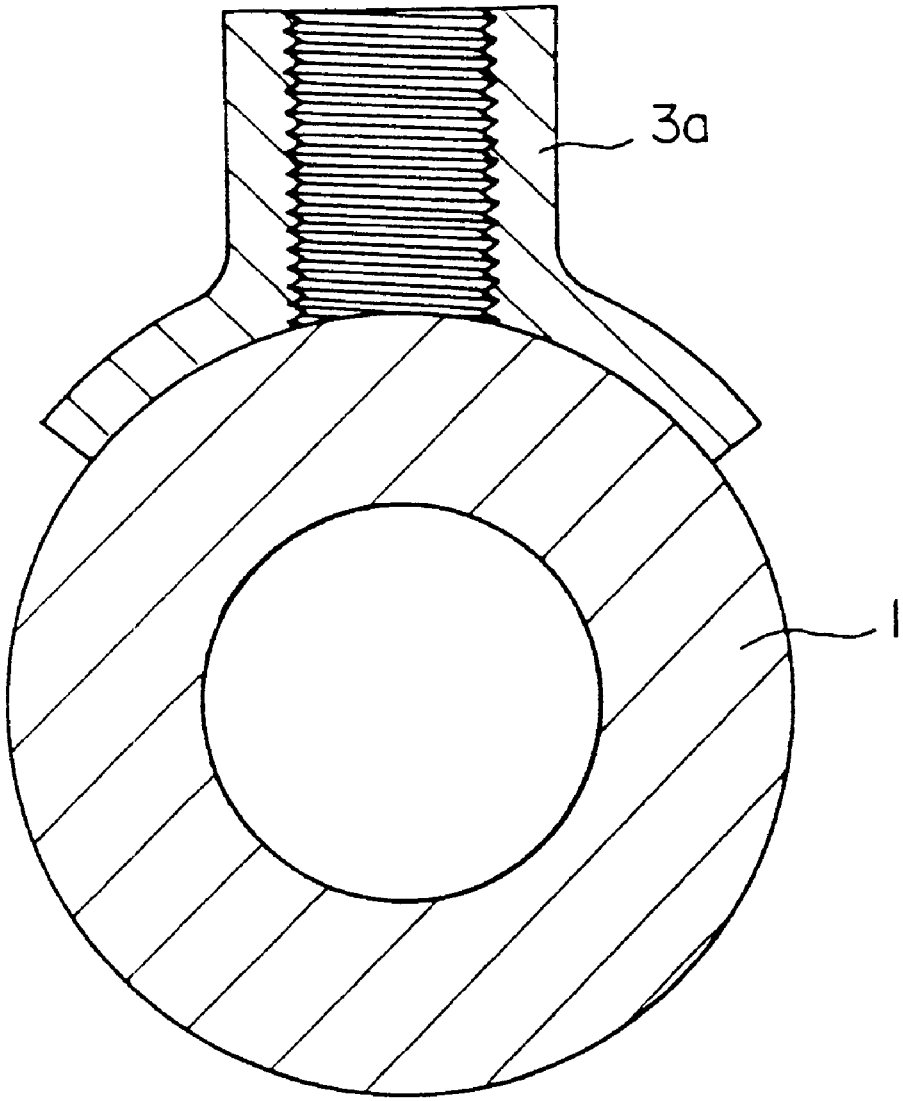
FIG. 10 is a vertical cross sectional view of a sleeve nipple portion which shows a common rail in accordance with the invention using a sleeve nipple having a different cross sectional shape.

In this case, as the sleeve nipple of the common rail in accordance with the invention, as shown in FIG. 10, a sleeve nipple 3*a* having a lower end which strides over the main pipe rail 1 may be employed in place of the sleeve nipple shown in FIGS. 1 to 9, as shown in FIG. 10.

Figure 11:
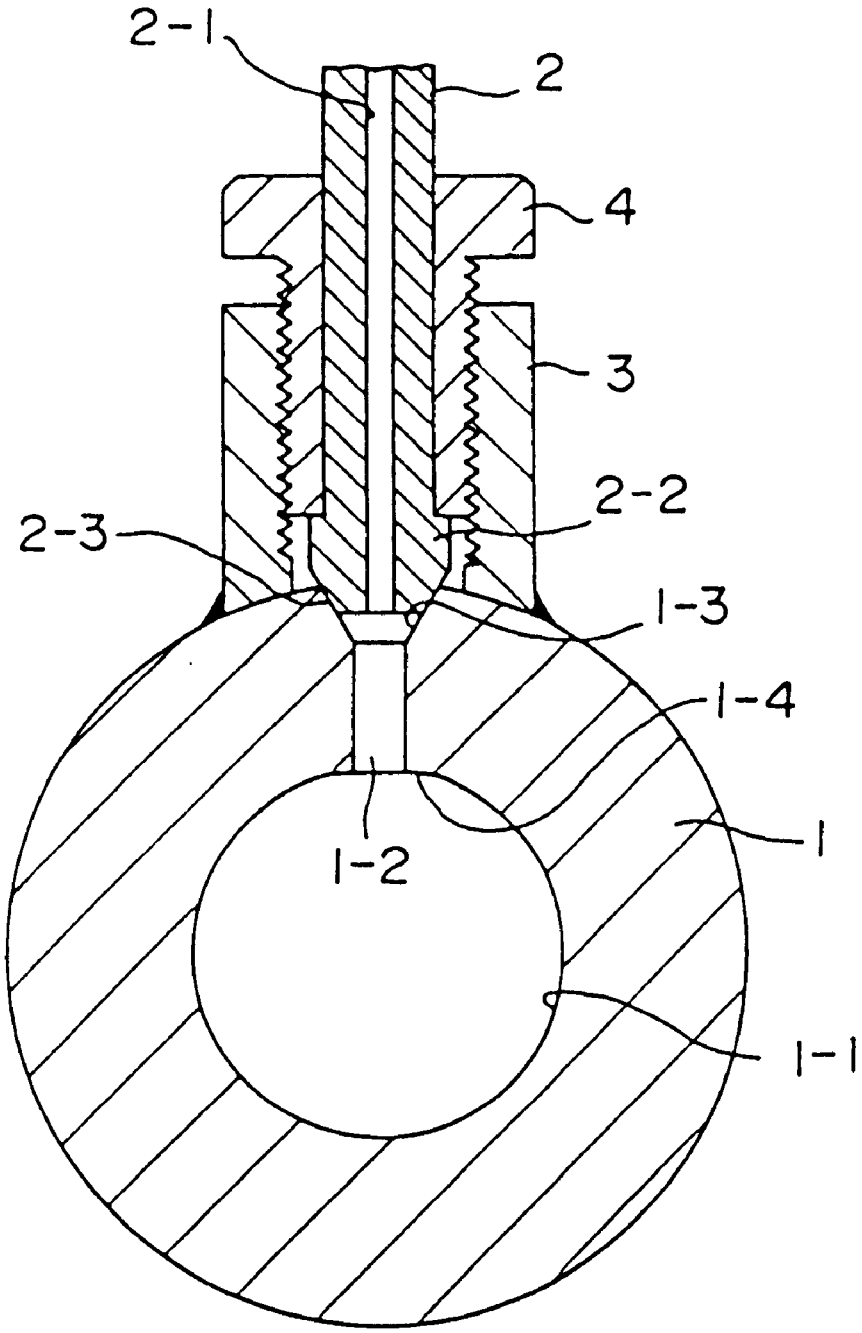
FIG. 11 is a vertical cross sectional view which shows an embodiment of a branch pipe connecting structure portion of the common rail manufactured by the manufacturing method in accordance with the invention.
Figure 12:
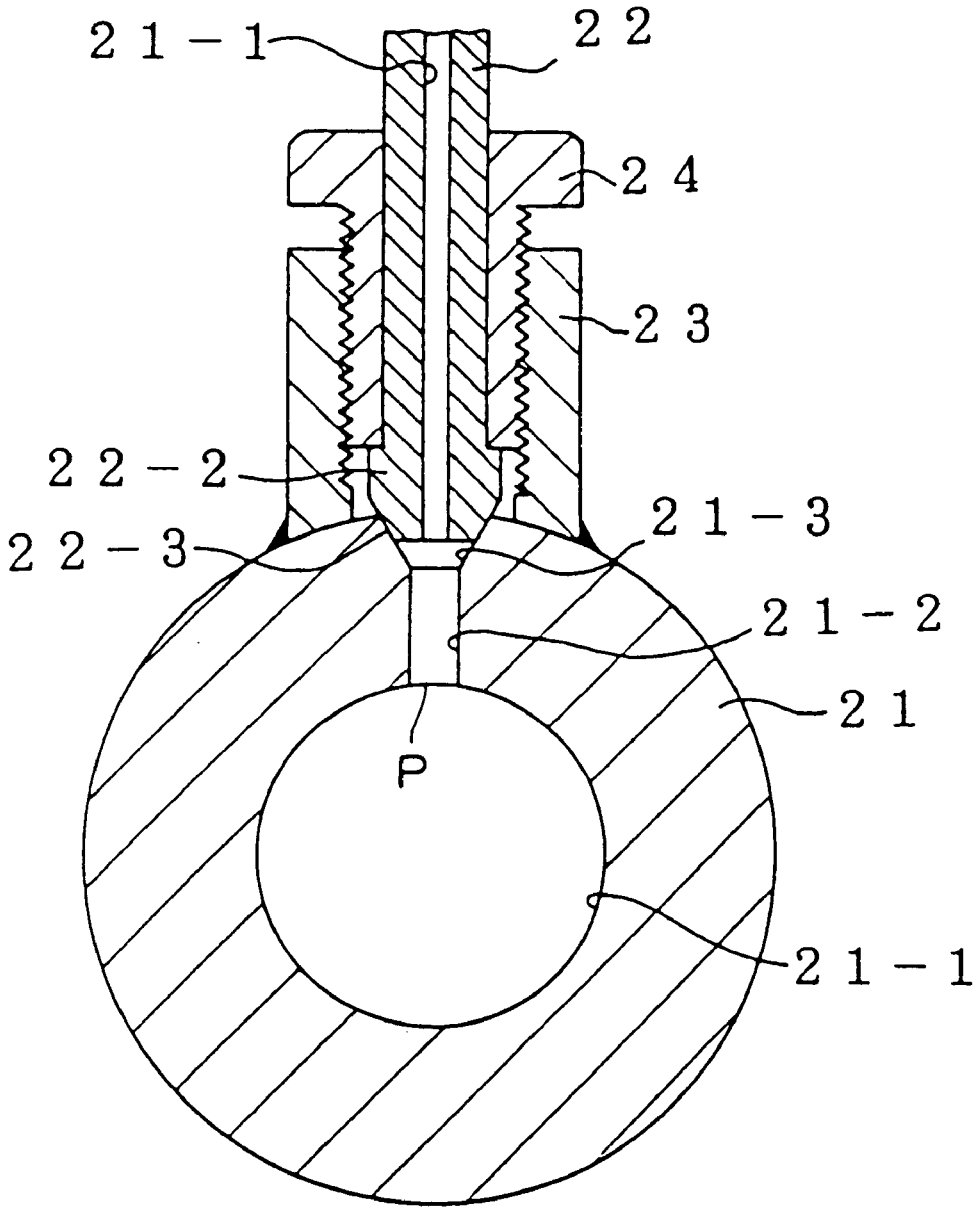
FIG. 12 is a vertical cross sectional view which shows a branch connecting structure portion of the conventional common rail which is a subject of the invention.

On the contrary, the branch pipe 2 is constituted by a branching pipe or a branch metal fitting, has the flow passage 2-1 communicating with the communication passage 1-1 of the main pipe rail 1 therewithin, and is provided with a pressing seat surface 2-3 constituted by the connection head portion 2-2 expanded by a buckling formation and having a conical front end in the end portion thereof, and the connection structure thereof is made in the same manner as that of the conventional manner, as shown in FIG. 11. Accordingly, the branch pipe 2 is fastened and connected together with a pressing of the fastening nut 4 under the neck of the connection head portion 2-2 by bringing the pressing seat surface 2-3 constituted by the connection head portion 2-2 close to the branch pipe 2 into contact with the pressure receiving surface 1-3 close to the main pipe rail 1, and by meshing the fastening nut 4 previously assembled in the branch pipe with the sleeve nipple 3 of the ring-like joint metal fitting 3.

As mentioned above, in accordance with the invention, a pressing force is applied to the sleeve nipple mounting portion of the main pipe rail 1 and the branch hole 1-2 communicating with the communication passage 1-1 of the main pipe rail 1 and having the pressure receiving seat surface 1-3 is formed in the corresponding portion. Since a compression residual stress is generated and remained near the open end portion of the communication passage of the main pipe rail in the branch pipe 1-2 by the pressure application process preferably together with forming the flat portion 1-4, a tensile stress generated in the lower end inner peripheral edge portion P of the branch hole 1-2 due to an axial force applied to the pressure receiving seat surface 1-3 can be widely reduced by a canceling effect of the compression residual stress together with the internal pressure of the main pipe rail 1 and the pressing of the connection head portion 2-2 of the branch pipe 2. Further, since the inner peripheral surface of the communication passage 1-1 of the main pipe rail near the branch hole 1-2 is slightly projected due to a pressure application by the press so as to form the flat portion 1-4, the stress generated in the branch hole 1-2 portion can be reduced. Accordingly, the common rail obtained by the method in accordance with the invention can further reduce the tensile stress generated in the lower end inner peripheral edge portion P of the branch hole 1-2 due to the compression residual stress and the flattening effect.

As mentioned above, since the common rail in accordance with the invention can cancel the generation of the tensile stress in the lower end inner peripheral edge portion of the branch hole by the compression residual stress so as to effectively restrict the tensile stress, and can improve the internal pressure fatigue strength in the branch pipe connecting portion, the common rail has excellent effect that a secure and stable function can be obtained by having an excellent durability and preventing a fluid leakage due to a generation of the crack generation. Further, in accordance with the method of manufacturing the common rail of the invention, since a pressure application process by the press is only added to the normal manufacturing process and no complex equipment is required, there is no problem that an equipment cost is increased by an increase of the process and a productivity is reduced, so that a great effect that a common rail having a high quality can be provided by a low cost can be obtained.

What is claimed is:

1. A common rail comprising a main pipe rail having an axially extending peripheral wall, said peripheral wall having an inner surface defining an axially extending communication passage, said inner surface being substantially cylindrically generated along major portions of said main pipe rail, at least one branch hole extending transversely through the peripheral wall and communicating with the communication passage of the main pipe rail, a pressure receiving seat surface formed in a peripheral surface portion of said branch hole and open to an outer portion of said main pipe rail for receiving a connection head portion disposed in an end portion of a branch pipe, and a sleeve nipple attached to the main pipe rail by welding or brazing, said sleeve nipple being for engagement with a nut previously assembled on the branch pipe for pressing said connection head portion against said pressure receiving seat so that the branch pipe and the main pipe rail are fastened and connected, a compression residual stress being produced in portions of the peripheral wall adjacent to the branch hole of the main pipe rail by applying a radial inward pressing force to outer peripheral surface regions of the peripheral wall surrounded by the sleeve nipple, said pressing force being sufficient to define a substantially planar surface area on the inner surface of the peripheral wall surrounding the branch hole, the planar portion of the inner surface of the peripheral wall intersecting the cylindrically generated portions of said inner surface.

2. A common rail according to claim 1, wherein said planar portion of said inner surface is substantially symmetrical with respect to said branch hole.

3. A common rail according to claim 1, wherein the main pipe wall has inside and outside diameters, the peripheral wall of the main pipe rail being sufficiently thick such that the inside diameter of the main pipe rail is less than half of the outside diameter of the main pipe rail.

4. A common rail according to claim 3, wherein the outside diameter of the main pipe rail is approximately 28 mm.

5. The common rail of claim 1, wherein the planar portions of the inner surface surrounding the branch hole define a chordal plane that extends continuously to the cylindrically generated portions of the inner surface.

6. The common rail of claim 5, wherein the chordal plane generated by the pressing force intersects the substantially cylindrical inner surface of the peripheral wall of the main pipe.

7. A common rail including a thick-walled main pipe with an axially extended peripheral wall having an inner surface defining an axially extending fluid passage and an opposed outer surface, said inner surface of said axially extending fluid passage being substantially cylindrical along a major portion of said main pipe, at least one cylindrical branch hole extending radially through the peripheral wall from the axially extending fluid passage to the outer surface of the main pipe, portions of the branch hole adjacent the outer surface defining an outwardly flared annular pressure receiving seat around the periphery of the branch hole, said pressure receiving seat being configured and dimensioned for abutting engagement with a connection head portion at an end of a branch pipe, a sleeve nipple fitted to the main pipe and having an internally threaded surface substantially concentrically aligned with the branch hole, the common rail being formed by the process comprising the steps of:

applying a radially inwardly directed pressing force on the outer surface of the peripheral wall of the main pipe at the location selected for the branch hole, the pressing force being sufficient to create a compression residual stress in portions of the peripheral wall at the selected location and sufficient to deform the peripheral wall for forming a planar portion defining a substantially chordal plane relative to the substantially cylindrically generated portions of said inner surface; and boring the branch hole at the selected location such that portions of the peripheral wall surrounding the branch hole are characterized by the compression residual stress.

* * * * *